US010714232B1

(12) United States Patent
Gebs et al.

(10) Patent No.: US 10,714,232 B1
(45) Date of Patent: Jul. 14, 2020

(54) TWISTED PAIR COMMUNICATION CABLES WITH FOAMED PVDF JACKETS

(71) Applicant: Superior Essex International LP, Atlanta, GA (US)

(72) Inventors: Bernhart A. Gebs, Powder Springs, GA (US); Christopher W. McNutt, Woodstock, GA (US)

(73) Assignee: Superior Essex International LP, Atlanta, GA (US)

( * ) Notice: Subject to any disclaimer, the term of this patent is extended or adjusted under 35 U.S.C. 154(b) by 0 days.

(21) Appl. No.: 16/386,961

(22) Filed: Apr. 17, 2019

(51) Int. Cl.

| | |
|---|---|
| ***H01B 7/17*** | (2006.01) |
| ***H01B 7/00*** | (2006.01) |
| ***H01B 11/02*** | (2006.01) |
| ***H01B 3/44*** | (2006.01) |
| ***H01B 11/00*** | (2006.01) |

(52) U.S. Cl.
CPC ..... *H01B 3/445* (2013.01); *H01B 7/17* (2013.01); *H01B 11/002* (2013.01)

(58) Field of Classification Search
CPC .... C08J 9/228; C08J 2207/06; C08J 2327/12; C08J 2327/16; C08L 23/28; C08L 101/00; H01B 3/445; H01B 7/17; H01B 7/00; H01B 7/0216; H01B 7/295; H01B 11/002; H01B 11/02; H02H 11/001
USPC ..... 174/113 R, 112; 521/139
See application file for complete search history.

(56) References Cited

U.S. PATENT DOCUMENTS

| | | | | |
|---|---|---|---|---|
| 3,763,093 | A * | 10/1973 | Kletecka et al. | C07D 209/48 524/101 |
| 4,692,381 | A * | 9/1987 | Pecsok | C08J 9/0023 264/45.9 |
| 6,037,546 | A * | 3/2000 | Mottine | H01B 3/441 174/110 PM |
| 6,147,309 | A | 11/2000 | Mottine et al. | |
| 8,277,913 | B2 | 10/2012 | Henry et al. | |
| 2008/0073105 | A1* | 3/2008 | Clark | H01B 7/0216 174/112 |
| 2018/0194915 | A1* | 7/2018 | Glew | C08L 23/28 |

OTHER PUBLICATIONS

American wire gauge—Wikipedia_pp. 1-6_Dec. 25, 2017.*
Kynar Brochure from Arkema.

* cited by examiner

*Primary Examiner* — Timothy J Thompson
*Assistant Examiner* — Guillermo J Egoavil

(57) ABSTRACT

A communication cable suitable for Power over Ethernet ("PoE") applications may include one or more twisted pairs of individually insulated conductors that are insulated with a material that includes fluorinated ethylene propylene. Additionally, a jacket that includes foamed polyvinylidene fluoride may be formed around the one or more twisted pairs. The PoE cable may have a higher maximum temperature rating and be capable of transmitting higher amperage signals than conventional PoE cables while satisfying applicable electrical performance criteria.

20 Claims, 2 Drawing Sheets

TWISTED PAIR COMMUNICATION CABLES WITH FOAMED PVDF JACKETS

TECHNICAL FIELD

Embodiments of the disclosure relate generally to communication cables and, more particularly, to twisted pair communication cables suitable for use in Power over Ethernet applications.

BACKGROUND

Twisted pair communication cables are commonly utilized to transmit Ethernet and other data signals. In certain applications, twisted pair cables are utilized to provide both data signals and electrical power to a wide variety of devices, such as lighting devices, wireless access points, etc. Typically, electrical power is provided over twisted pairs in accordance with a Power over Ethernet ("PoE") standard. Conventional PoE cables typically include outer jackets formed from polyvinyl chloride ("PVC") materials. However, PVC materials have a maximum temperature rating of 105° C., which limits an amount of power that can be transmitted via a PoE cable. Current PoE cables with a PVC jacket are typically rated transmit a 0.7 ampere signal at up to a 90° C. operating temperature. Further, PVC materials will often degrade over time at sustained higher temperatures near their rated temperature.

As electrical power requirements increase, it is desirable to transmit higher current and/or higher power signals via PoE cables. Additionally, twisted pair cables are often required to satisfy ever increasing bandwidth requirements. Potential jacket materials having higher temperature ratings that may be utilized to enhance the power transmission capabilities of twisted pair cables, such as polyvinylidene fluoride ("PVDF"), negatively impact the electrical performance of twisted pair conductors. The dielectric constant and dissipation factors of PVDF and similar materials adversely affect the electrical performance of the cable. Accordingly, there is an opportunity for improved twisted pair PoE cables that include foamed PVDF jackets and that satisfy desired electrical performance criteria. There is also an opportunity for improved twisted pair PoE cables having higher temperature ratings, such as a temperature rating of 125° C. or higher. There is further an opportunity for improved twisted pair PoE cables that are suitable for transmission of higher amperage and/or power signals than conventional PoE cables.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items; however, various embodiments may utilize elements and/or components other than those illustrated in the figures. Additionally, the drawings are provided to illustrate example embodiments described herein and are not intended to limit the scope of the disclosure.

DETAILED DESCRIPTION

Figure 1:
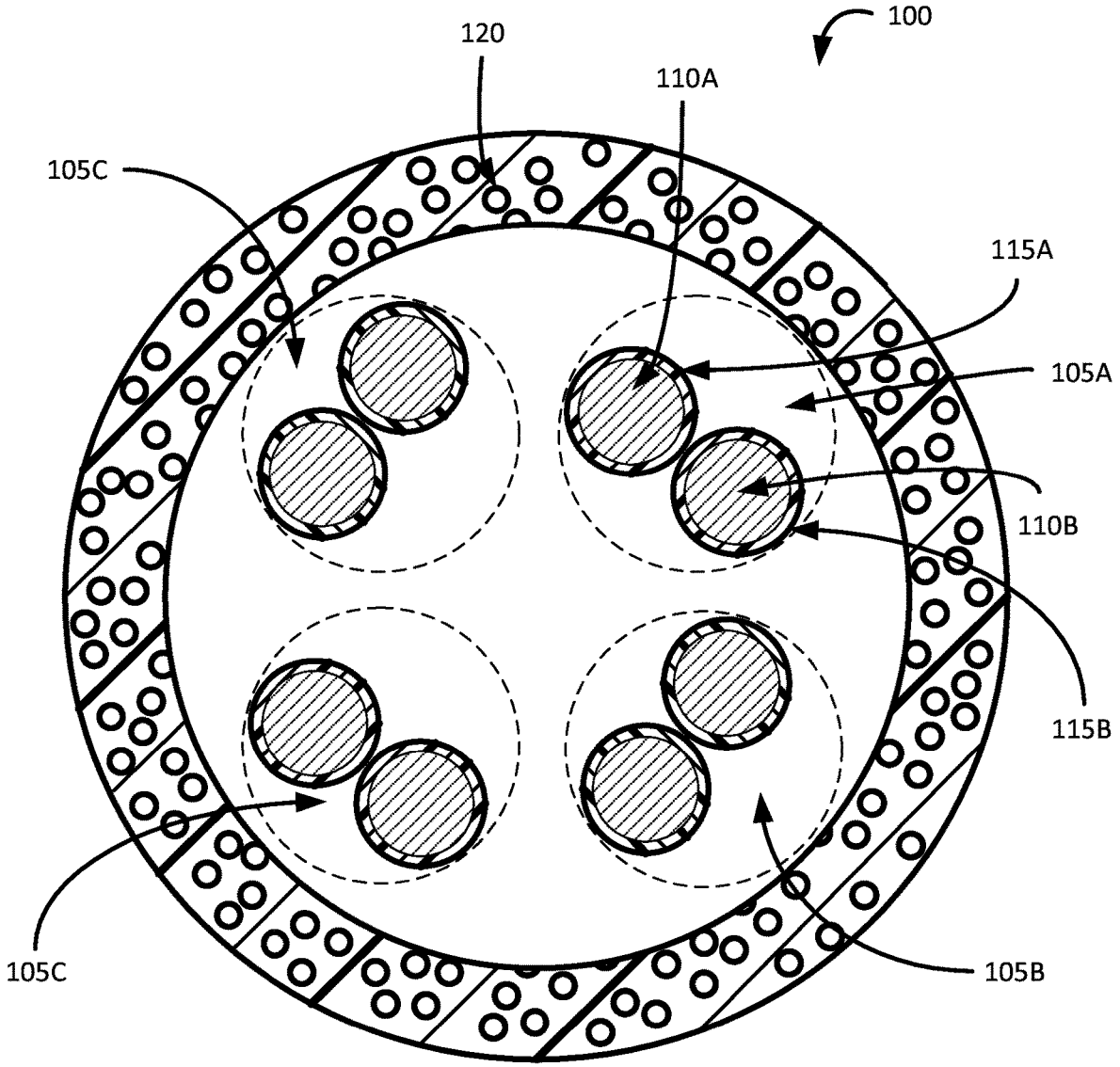
FIG. 1 is a cross-sectional view of an example twisted pair cable suitable for use in Power over Ethernet applications that includes a foamed PVDF jacket, according to an illustrative embodiment of the disclosure.

Various embodiments of the present disclosure are directed to twisted pair cables suitable for use in Power over Ethernet ("PoE") applications. According to an aspect of the disclosure, a communication cable may include one or more twisted pairs of individually insulated conductors. The insulation formed around each of the conductors of the twisted pair(s) may include fluorinated ethylene propylene ("FEP"). In certain embodiments, each conductor may be a 22 American Wire Gauge ("AWG") or greater conductor. For example, each conductor may have a diameter that is equal to or greater than approximately 0.0240 inches. Additionally, a jacket may be formed around the one or more twisted pairs. According to an aspect of the disclosure, the jacket may be formed at least partially from foamed polyvinylidene fluoride ("PVDF"). The PVDF may be formed with a wide variety of suitable foam rates as desired. For example, the PVDF may be formed with a foam rate between approximately twenty percent and approximately fifty percent.

As a result of utilizing FEP as conductor insulation and foamed PVDF as a jacket material, the inventive PoE cables may have higher maximum temperature ratings than conventional PoE cables, such as conventional cables that utilize polyvinyl chloride ("PVC") jackets. In certain embodiments, a PoE cable may have a maximum temperature rating or maximum operating temperature rating of at least 125° C. In various embodiments, a PoE cable may have a maximum temperature rating of at least 110° C., 115° C., 120° C., 125° C., 130° C., 135° C., 140° C., 145° C., or 150° C. The higher maximum temperature rating may facilitate transmission of higher amperage and/or higher power signals relative to conventional PoE cables. In certain embodiments, a PoE cable may be capable of transmitting a signal having a current of approximately 0.80 amps at approximately 110° C. for at least 10 years and, preferably, for at least 25 years. In other embodiments, a PoE cable may be capable of transmitting a signal having a current of approximately 0.90 amps at approximately 125° C. for at least 10 years and, preferably, for at least 25 years. Further, the FEP insulation and PVDF jacket may be capable of relatively long term use without degradation.

In certain embodiments, the PVDF jacket may facilitate installation of a PoE cable within a plenum environment. In other words, the PVDF jacket may assist a cable in satisfying the fire safety requirements of one or more plenum standards. A cable incorporating a foamed jacket may satisfy a wide variety of suitable plenum standards such as National Fire Protection Association ("NFPA") standards NFPA 90A and NFPA 262. Further, although solid PVDF may negatively impact the electrical performance of a twisted pair cable due to adverse effects resulting from the dielectric constant and dissipation factor of the PVDF material, foaming a PVDF jacket mitigates the negative impacts. The foaming process effectively reduces the dielectric constant and the dissipation factor of the PVDF by introducing air (or gas) in lieu of solid high loss material. As a result, a twisted pair PoE cable incorporating a foamed PVDF jacket may satisfy a wide variety of suitable electrical performance standards. For example, a cable may satisfy a Category 5, Category 5e, Category 6, Category 6A, Category 8 or other Category cable standard, such any of the standards set forth in ANSI/TIA-568 established by the Telecommunications Industry Association ("TIA"). In one example embodiment, a cable may satisfy the Category 6 and/or Category 6A electrical performance requirements for standard ANSI/TIA-568.2-D as published in 2018.

Embodiments of the disclosure now will be described more fully hereinafter with reference to the accompanying drawings, in which certain embodiments of the disclosure are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

With reference to FIG. 1, a cross-section of an example cable 100 suitable for use in PoE applications and that includes a foamed PVDF jacket is illustrated. The cable 100 is illustrated as a twisted pair communications cable; however, embodiments of the disclosure may additionally be applicable to composite or hybrid cables that include a combination of twisted pairs and other transmission media (e.g., optical fibers, etc.). Indeed, suitable cables may include any number of transmission media including but not limited to one or more twisted pairs, optical fibers, coaxial cables, and/or power conductors.

As shown in FIG. 1, the cable 100 may include four twisted pairs 105A, 105B, 105C, 105D; however, any other suitable number of pairs may be utilized. Each twisted pair (referred to generally as twisted pair 105) may include two electrical conductors 110A, 110B, each covered with respective insulation 115A, 115B. The electrical conductors (generally referred to as conductor 110) of a twisted pair 105 may be formed from any suitable electrically conductive material, such as copper, aluminum, silver, annealed copper, gold, a conductive alloy, etc. Additionally, the electrical conductors 110 may have any suitable diameter, gauge, and/or other dimensions. Further, each of the electrical conductors 110 may be formed as either a solid conductor or as a conductor that includes a plurality of conductive strands that are twisted together.

According to an aspect of the disclosure, the electrical conductors 110 of certain twisted pairs (e.g., illustrated twisted pairs 105A-D, etc.) may be 22 AWG or larger conductors. In other words, electrical conductors 110 may have a diameter and/or cross-sectional area that is greater than or equal to required minimum dimensions for 22 AWG conductors. For example, electrical conductors 110 may have a diameter that is greater than or equal to approximately 0.0240 inches (0.6096 mm). In various embodiments, electrical conductors 110 may have diameters that are greater than or equal to approximately 0.0240, 0.0245, 0.0250, 0.0252, 0.0253, 0.0255, 0.0257, 0.0259, 0.0260, 0.0265, or 0.0271 inches, or diameters incorporated in a range between any two of the above values. Additionally, the electrical conductors 110 and/or certain twisted pairs may be capable of transmitting a desired power signal for PoE applications. The power transmitted by each set of twisted pairs may be equal to the current carried by each twisted pair multiplied by the voltage between the two twisted pairs. The current and/or voltage on/between each twisted pair may be adjusted as desired in order to attain a desired power signal.

The twisted pair insulation (generally referred to as insulation 115) may provide electrical isolation between the conductors 110A, 110B of a given twisted pair 105 and/or the conductors of other twisted pairs. The insulation 115 may be formed from a suitable dielectric material and/or a combination of dielectric materials. According to an aspect of the disclosure, the insulation 115 may include fluorinated ethylene propylene ("FEP"). In various embodiments, twisted pair insulation 115 may be formed from one or multiple layers of insulation material. In certain embodiments, insulation 115 may be formed from a single layer of FEP material. In other embodiments, insulation 115 may include a plurality of layers. As desired, multiple layers may be formed from the same or similar material. For example, insulation 115 may include two layers of solid FEP material (e.g., two layers of the same grade of FEP, two layers of different grades of FEP material). As another example, insulation 115 may include at least one layer of foamed FEP material and at least one layer of solid FEP material. In other embodiments, multi-layer insulation 115 may include at least two layers formed from different materials. For example, insulation 115 may include a first layer formed from FEP and a second layer formed from another polymeric material. As another example, insulation 115 may include a first layer formed from foamed FEP and an outer skin layer formed from a different polymeric material.

Regardless of the number of layers included in the insulation 115, a layer of insulation may be formed as solid insulation, unfoamed insulation, foamed insulation, or other suitable insulation. For example, a layer of FEP insulation may be formed as solid FEP insulation or as foamed FEP insulation. As desired, combinations of different types of insulation may be utilized. For example, a foamed insulation layer may be covered with a solid foam skin layer. Additionally, any suitable foam rates may be utilized for FEP insulation. As desired with foamed insulation, different foaming levels may be utilized for different twisted pairs in accordance with twist lay length to assist in balancing propagation delays between the twisted pairs.

Additionally, the insulation 115 may be formed with any suitable thickness, inner diameter, outer diameter, and/or other dimensions. For example, the insulation 115 may be formed with a thickness between approximately 0.005 inches (0.13 mm) and approximately 0.015 inches (0.38 mm). In various embodiments, the insulation 115 may have a thickness of approximately 0.005, 0.006, 0.007, 0.008, 0.009, 0.010, 0.011, 0.012, 0.013, 0.014, or 0.015 inches, a thickness included in a range between any two of the above values, or a thickness included in a range bounded on either a minimum or maximum end by one of the above values. As desired in certain embodiments, insulation 115 may additionally include a wide variety of other materials (e.g., filler materials, materials compounded or mixed with a base insulation material, etc.), such as smoke suppressant materials, flame retardant materials, etc.

Each twisted pair 105 can carry data or some other form of information, for example in a range of about one to ten Giga bits per second ("Gbps") or other suitable data rates, whether higher or lower. In certain embodiments, each twisted pair 105 supports data transmission of about two and one-half Gbps (e.g. nominally two and one-half Gbps), with the cable 100 supporting about ten Gbps (e.g. nominally ten Gbps). In certain embodiments, each twisted pair 105 supports data transmission of up to about ten Gbps (e.g. nominally ten Gbps), with the cable 100 supporting about forty Gbps (e.g. nominally forty Gbps).

In certain embodiments, two or more twisted pairs may be formed with different respective twist lays. For example, in the illustrated four pair cable, each of the twisted pairs 105A-D may have a different twist lay. The different twist lays may function to reduce crosstalk between the twisted pairs, and a wide variety of suitable twist lay configurations may be utilized. As desired, the respective twist lays for the twisted pairs 105A-D may be selected, calculated, or determined in order to result in a cable 100 that satisfies one or more standards and/or electrical requirements. For example, twist lays may be selected such that the cable 100 satisfies one or more electrical requirements of a Category 6 or Category 6A standard, such as the TIA 568 standard set forth by the Telecommunications Industry Association. In certain embodiments, each of the twisted pairs 105A-D may be twisted in the same direction (e.g., a clockwise or counter-clockwise direction). In other embodiments, at least two twisted pairs may be twisted in opposite directions.

In certain example embodiments, each of the twisted pairs 105A-D suitable for use in a PoE application may have a twist lay included in a range between approximately 0.292 inches and approximately 0.504 inches. For example, each of the twisted pairs 105A-D may have a different twist lay with each respective twist lay being between approximately 0.292 inches and approximately 0.504 inches. Indeed, a wide variety of suitable ranges of twist lays may be utilized as desired. In various embodiments, a minimum value for a twist lay range may be approximately 0.292, 0.299, 0.304, 0.309, 0.315, or 0.325 inches. A maximum value for a twist lay range may be approximately, 0.458, 0.467, 0.481, 0.487, 0.494, or 0.504 inches. A suitable twist lay range may be formed using any combination of the minimum or maximum values listed above.

As desired in various embodiments, the differences between twist lays of twisted pairs 105 that are circumferentially adjacent one another (for example the twisted pair 105A and the twisted pair 105B) may be greater than the differences between twist lays of twisted pairs 105 that are diagonal from one another (for example the twisted pair 105A and the twisted pair 105C). As a result of having similar twist lays, the twisted pairs that are diagonally disposed can be more susceptible to crosstalk issues than the twisted pairs 105 that are circumferentially adjacent; however, the distance between the diagonally disposed pairs may limit the crosstalk. Thus, the different twist lays and arrangements of the pairs can help reduce crosstalk among the twisted pairs 105. In certain embodiments, the plurality of twisted pairs 105A-D may also be twisted together with an overall twist or bunch. Any suitable overall twist lay or bunch lay may be utilized, such as a bunch lay between approximately 1.9 inches and approximately 15.0 inches. For example, a bunch lay may be approximately 1.9, 2.0, 2.5, 3.0, 3.5, 3.75, 4.0, 4.25, 4.5, 4.75, 5.0, 5.5, 6.0, 7.0, 7.5, 8.0, 9.0, 10.0, 11.0, 12.0, or 15.0 inches, or any value included in a range between two of the previously listed values (e.g., a bunch lay between approximately 3.5 and approximately 4.5 inches, etc.), or any value included in a range bounded on either a minimum or maximum end by one of the above values (e.g., a bunch lay that is less than or equal to approximately 4.25 inches, etc.). Further, in certain embodiments, the twisting of the twisted pairs 105A-D and the overall bunch may be in the same direction (e.g., clockwise, counter-clockwise). In other embodiments, an overall bunch lay may be formed in an opposite direction to the twisted pairs 105A-D. In yet other embodiments, an overall bunch lay may be formed in an opposite direction to a portion or subset of the twisted pairs 105A-D. Indeed, a wide variety of suitable combinations of twist lays and/or twist directions may be utilized.

As desired in certain embodiments, one or more suitable bindings or wraps may be wrapped or otherwise formed around the twisted pairs 105A-D once they are twisted together. Additionally, in certain embodiments, multiple grouping of twisted pairs may be incorporated into a cable. As desired, each grouping may be twisted, bundled, and/or bound together. Further, in certain embodiments, the multiple groupings may be twisted, bundled, or bound together.

With continued reference to FIG. 1, a jacket 120 may define an outer periphery of the cable 100. The jacket 120 may enclose the internal components of the cable 100, seal the cable 100 from the environment, and provide strength and structural support. As desired, the jacket 120 may be characterized as an outer sheath, a casing, a circumferential cover, or a shell. An opening enclosed by the jacket 120 may be referred to as a cable core, and the twisted pairs 105A-D and/or other cable components may be disposed within the cable core. Although a single cable core is illustrated in the cable 100 of FIG. 1, a cable may be formed to include multiple cable cores. In certain embodiments, the cable core may be filled with a gas such as air (as illustrated) or alternatively a gelatinous, solid, powder, moisture absorbing material, water-swellable substance, dry filling compound, or foam material, for example in interstitial spaces between the twisted pairs 105A-D. Other elements can be added to the cable core as desired, for example one or more optical fibers, additional electrical conductors, additional twisted pairs, water absorbing materials, and/or strength members, depending upon application goals.

According to an aspect of the disclosure, the jacket 120 may be formed at least partially from foamed polyvinylidene fluoride ("PVDF"). In certain embodiments, the jacket 120 may be formed as a single layer of foamed material. In other embodiments, the jacket 120 may include a plurality of layers of material. As desired in certain embodiments, multiple layers may be formed from similar materials (i.e., foamed PVDF). In other embodiments, at least two layers of a jacket may be formed from different materials. For example, a solid layer of polymeric material may be formed over a layer of foamed PVDF material. The foamed PVDF layer may enhance cable performance (e.g., temperature rating, etc.) while a solid layer provided enhanced stiffness and/or structural support. In certain embodiments, use of a solid layer in conjunction with a foamed PVDF layer may permit a higher foaming rate of the foamed layer while still allowing the jacket to provide sufficient structural support for the cable 100. In yet other embodiments, a jacket 120 may include a skin layer (e.g., a thin layer of solid material) formed over a foamed PVDF layer. The skin layer may be formed from PVDF or, alternatively, from a different polymeric material.

A foamed PVDF jacket 120 and/or various layers of a jacket 120 may be formed with any suitable thickness. For example, a foamed jacket (or foamed jacket layer) may be formed with a thickness between approximately 0.078 inches (0.20 mm) and approximately 0.10 inches (2.54 mm). In various embodiments, a foamed jacket (or foamed jacket layer) may have a thickness of approximately 0.078 (0.20 mm), 0.012 (0.30 mm), 0.016 (0.40 mm), 0.020 (0.50 mm), 0.024 (0.60 mm), 0.031 (0.80 mm), 0.039 (1.0 mm), 0.049 (1.25 mm), 0.059 (1.5 mm), 0.069 (1.75 mm), 0.079 (2.0 mm), 0.088 (2.25 mm), 0.098 (2.50 mm), or 0.10 (2.54 mm) inches, a thickness included in a range between any two of the above values, or a thickness included in a range bounded on either a minimum or maximum end by one of the above values.

A foamed PVDF jacket 120 (or foamed jacket layer) may be formed with a wide variety of suitable foam rates as desired in various embodiments. For example, the PVDF material may be foamed at a rate between approximately twenty percent (20%) and approximately 50%). In certain embodiments, the PVDF material may be foamed at a rate between approximately thirty percent (30%) and approximately forty percent (40%), such as a rate of approximately thirty-five percent (35%). In various embodiments, the PVDF material may be foamed at a rate of approximately 10, 15, 20, 25, 30, 35, 40, 45, or 50 percent, at a foam rate included in a range between any two of the above values, or at a foam rate included in a range bounded on a minimum end by one of the above values (e.g., a foam rate of at least 30 percent, etc.).

A wide variety of methods or techniques may be utilized to foam the PVDF material incorporated into a jacket 120. For example, one or more foaming agent may be added to a polymer. Foaming agents may be added at any suitable concentrations or amounts in order to achieve a desired foam rate. In certain embodiments, a chemical foaming agent or a foam concentrate may be utilized. In other embodiments, foaming may be facilitated by injection of a gas foaming agent (e.g., Freon, nitrogen, etc.). Typically, a foaming agent may be added to a PVDF polymer during processing of the polymer within an extrusion system. The extrusion system may then extrude the polymer onto a cable 100 as a jacket layer.

In addition to polymeric PVDF material and a foaming agent, a wide variety of fillers and/or other additives may be incorporated into a foamed jacket layer as desired in various embodiments. These additives include, but are not limited to, flame retardant materials, impact modifiers, smoke suppressants, dyes, and/or colorants. Additives or fillers may be added in any suitable amounts, rates, or levels.

As a result of utilizing FEP as conductor insulation 115 and foamed PVDF jacket 120, the cable 100 may have higher maximum temperature ratings than conventional PoE cables, such as conventional cables that utilize PVC jackets. In certain embodiments, the cable 100 may have a maximum temperature rating or maximum operating temperature rating of at least 125° C. In various embodiments, the cable 100 may have a maximum temperature rating of at least 110° C., 115° C., 120° C., 125° C., 130° C., 135° C., 140° C., 145° C., or 150° C.

The higher maximum temperature rating may facilitate transmission of higher amperage and/or higher power signals relative to conventional PoE cables. In certain embodiments, a PoE cable may be capable of transmitting a signal having a current of approximately 0.80 amps at approximately 110° C. for at least 10 years and, preferably, for at least 25 years. In other embodiments, a PoE cable may be capable of transmitting a signal having a current of approximately 0.90 amps at approximately 125° C. for at least 10 years and, preferably, for at least 25 years. Further, the FEP insulation 115 and PVDF jacket 120 may be capable of relatively long term use without degradation.

In certain embodiments, the PVDF jacket 120 may facilitate installation of the cable 100 within a plenum environment. In other words, the PVDF jacket 120 may assist the cable 100 in satisfying the fire safety requirements of one or more plenum standards. The cable 100 may satisfy a wide variety of suitable plenum standards such as National Fire Protection Association ("NFPA") standards NFPA 90A and NFPA 262.

Further, although solid PVDF may negatively impact the electrical performance of the twisted pairs 105A-D due to adverse effects resulting from the dielectric constant and dissipation factor of the PVDF material, foaming the PVDF jacket 120 mitigates these negative impacts. The foaming process effectively reduces the dielectric constant and the dissipation factor of the PVDF by introducing air (or gas) in lieu of solid high loss material. As a result, the cable 100 may satisfy a wide variety of suitable electrical performance standards. For example, the cable 100 may satisfy a Category 5, Category 5e, Category 6, Category 6A, Category 8 or other Category cable standard, such any of the standards set forth in ANSI/TIA-568 established by the Telecommunications Industry Association ("TIA"). In one example embodiment, the cable 100 may satisfy the Category 6 and/or Category 6A electrical performance requirements for standard ANSI/TIA-568.2-D as published in 2018.

Figure 2:
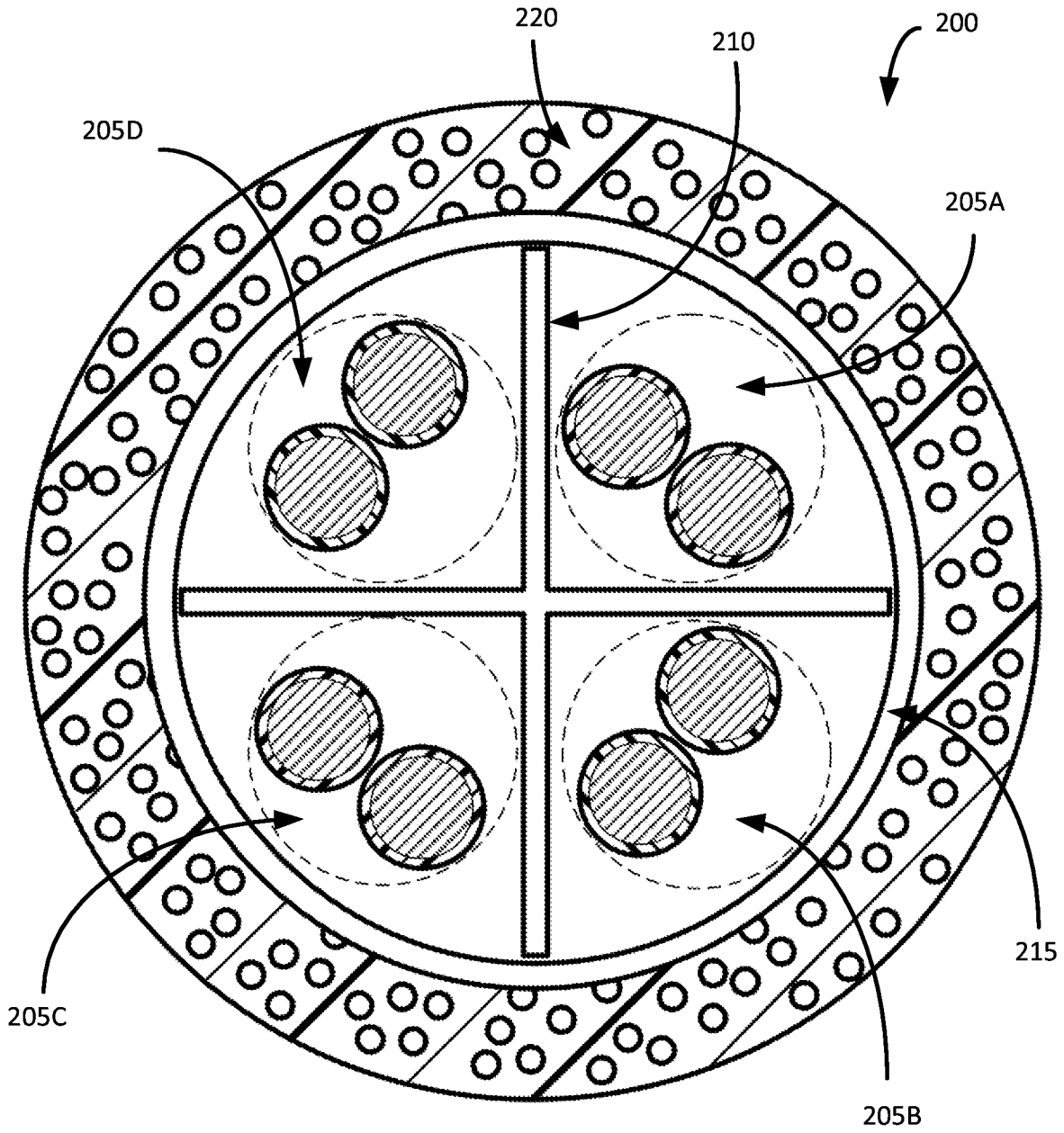
FIG. 2 is a cross-sectional view of another example twisted pair cable suitable for use in Power over Ethernet applications that includes a foamed PVDF jacket, according to an illustrative embodiment of the disclosure.

As desired in various embodiments, a wide variety of other materials may be incorporated into the cable 100. For example, as set forth above, a cable may include any number of conductors, twisted pairs, optical fibers, and/or other transmission media. As shown in FIG. 2, the cable 100 may also include a separator positioned between two or more of the twisted pairs 105A-D and/or one or more shield elements. As desired, a cable may include a wide variety of strength members, swellable materials (e.g., aramid yarns, blown swellable fibers, etc.), insulating materials, dielectric materials, flame retardants, flame suppressants or extinguishants, gels, and/or other materials. The cable 100 illustrated in FIG. 1 is provided by way of example only. Embodiments of the disclosure contemplate a wide variety of other cables and cable constructions. These other cables may include more or less components than the cable 100 illustrated in FIG. 1. Additionally, certain components may have different dimensions and/or materials than the components illustrated in FIG. 1.

FIG. 2 is a cross-sectional view of another example twisted pair cable 200 suitable for use in Power over Ethernet applications that includes a foamed PVDF jacket, according to an illustrative embodiment of the disclosure. The cable 200 of FIG. 2 may include certain components that are similar to the cable 100 of FIG. 1. For example, the cable 200 may include a plurality of twisted pairs 205A-D of individually insulated conductors. Additionally, a foamed PVDF jacket 220 may be formed around the plurality of twisted pairs 205A-D. In contrast to the cable of FIG. 1, the cable 200 of FIG. 2 is also illustrated as including a separator 210 and an outer shield 215. Each of these components is described in greater detail below.

As desired, a suitable separator 210, spline, or filler may be positioned between two or more of the twisted pairs 205A-D. The separator 210 may be disposed within the cable core and configured to orient and or position one or more of the twisted pairs 205A-D. The orientation of the twisted pairs 205A-D relative to one another may provide beneficial signal performance. The separator 210 may be formed in accordance with a wide variety of suitable dimensions, shapes, or designs. For example, the separator 210 may be formed as an X-shaped separator or cross-filler. In other embodiments, a rod-shaped separator, a flat tape separator, a flat separator, a T-shaped separator, a Y-shaped separator, a J-shaped separator, an L-shaped separator, a diamond-shaped separator, a separator having any number of spokes extending from a central point, a separator having walls or channels with varying thicknesses, a separator having T-shaped members extending from a central point or center member, a separator including any number of suitable fins, and/or a wide variety of other shapes may be utilized.

In certain embodiments, the separator 210 may be continuous along a longitudinal length of the cable 200. In other embodiments, the separator 210 may be non-continuous or discontinuous along a longitudinal length of the cable 200. In other words, the separator 210 may be separated, segmented, or severed in a longitudinal direction such that discrete sections or portions of the separator 210 are arranged longitudinally (e.g., end to end) along a length of the cable 200. Use of a non-continuous or segmented separator may enhance the flexibility of the cable 200, reduce an amount of material incorporated into the cable 200, and/or reduce cost.

A wide variety of suitable techniques may be utilized to form a separator 210. For example, in certain embodiments, material may be extruded, cast, molded, or otherwise formed into a desired shape to form the separator. In other embodiments, various components of a separator may be separately formed, and then the components of the separator may be joined or otherwise attached together via adhesive, bonding (e.g., ultrasonic welding, etc.), or physical attachment elements (e.g., staples, pins, etc.). In yet other embodiments, a tape may be provided as a substantially flat separator or formed into another desired shape utilizing a wide variety of folding and/or shaping techniques. For example, a relatively flat tape may be formed into an X-shape or cross-shape as a result of being passed through one or more dies. In other embodiments, a plurality of tapes may be combined in order to form a separator having a desired cross-sectional shape. For example, two tapes may be folded at approximately ninety degree angles and bonded together to form a cross-shaped separator. As another example, four tapes may be folded at approximately ninety degree angles and bonded to one another to form a cross-shaped separator. A wide variety of other suitable construction techniques may be utilized as desired. Additionally, in certain embodiments, a separator 210 may be formed to include one or more hollow cavities that may be filled with air or some other gas, moisture mitigation material, one or more optical fibers, one or more metallic conductors (e.g., a drain wire, etc.), shielding, or some other appropriate material or element.

The separator 210 (and/or various segments, projections, and/or other components of the separator 210) may be formed from a wide variety of suitable materials and/or combinations of materials as desired in various embodiments. For example, the separator 210 may include paper, metallic material (e.g., aluminum, ferrite, etc.), alloys, semi-conductive materials, ferrite ceramic materials, various plastics, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, choloro-sulphonated polyethylene, flame retardant PVC, low temperature oil resistant PVC, flame retardant polyurethane, flexible PVC, or any other suitable material or combination of materials. As desired, the separator 125 may be filled, unfilled, foamed, solid, homogeneous, or inhomogeneous and may or may not include additives (e.g., flame retardant and/or smoke suppressant materials). As desired, the separator 210 may include one or more strength members, fibers, threads, and/or yarns. Similarly, flame retardant material, smoke suppressants, and/or other desired substances may be blended or incorporated into a separator 210. In certain embodiments, a separator 210 may include or incorporate one or more shielding materials, such as electrically conductive shielding material, semi-conductive material, and/or dielectric shielding material (e.g., ferrite ceramic material, etc.). As a result of incorporating electrically conductive material, the separator 210 may function as a shielding element.

As desired in various embodiments, one or more shield elements or shielding elements may be incorporated into the cable 200. Each shielding element may incorporate one or more shielding materials, such as electrically conductive shielding material, semi-conductive material, and/or dielectric shielding material (e.g., ferrite ceramic material, etc.). In certain embodiments, a shield layer, such as the shield layer 215 illustrated in FIG. 2, may be positioned within a cable core. As shown in FIG. 2, an overall shield 215 or shield layer may be formed around the plurality of twisted pairs 205A-D and the optional separator 210. In other embodiments, individual shield layers may be respectively formed around each of the twisted pairs 205A-D. In yet other embodiments, one or more shield layers may be formed around desired subgroups of the twisted pairs 205A-D. In other embodiments, a shield layer may be incorporated into the outer jacket 220. For example, the shield layer 215 may be sandwiched between two other layers of outer jacket material, such as two dielectric layers. In certain embodiments, shielding material may also be incorporated into cable separators or fillers positioned between two or more of the pairs 205A-D. Similarly, shielding material may be incorporated into separation elements (e.g., film layers, etc.) that are positioned between the individual conductors of one or more twisted pairs. A wide variety of other suitable shielding arrangements may be utilized as desired in other embodiments. Further, in certain embodiments, a cable may include a separate, armor layer (e.g., a corrugated armor, etc.) for providing mechanical protection.

The external or overall shield 215 will now be described herein in greater detail; however, it will be appreciated that other shield layers may have similar constructions. In certain embodiments, a shield 215 may be formed from a single segment or portion that extends along a longitudinal length of the cable 200. In other embodiments, a shield 215 may be formed from a plurality of discrete segments or portions positioned adjacent to one another along a longitudinal length of the cable 200. In the event that discrete segments or portions are utilized, in certain embodiments, gaps or spaces may exist between adjacent segments or portions. In other embodiments, certain segments may overlap one another. For example, an overlap may be formed between segments positioned adjacent to one another in a longitudinal direction.

As desired, a wide variety of suitable techniques and/or processes may be utilized to form a shield 215 (or a shield segment). For example, a base material or dielectric material may be extruded, poltruded, or otherwise formed. Electrically conductive material or other shielding material may then be applied to the base material. In other embodiments, shielding material may be injected into the base material. In other embodiments, dielectric material may be formed or extruded over shielding material in order to form a shield 215. In certain embodiments, the base layer may have a substantially uniform composition and/or may be made of a wide range of materials. Additionally, the base layer may be fabricated in any number of manufacturing passes, such as a single manufacturing pass. Further, the base layer may be foamed, may be a composite, and/or may include one or more strength members, fibers, threads, or yarns. As desired, flame retardant material, smoke suppressants, and/or other desired substances may be blended or incorporated into the base layer.

In certain embodiments, the shield 215 (or individual shield segments) may be formed as a tape that includes both a dielectric layer and an electrically conductive layer (e.g., copper, aluminum, silver, an alloy, etc.) or other suitable layer of shielding material formed on one or both sides of the dielectric layer. Examples of suitable materials that may be used to form a dielectric layer include, but are not limited to, various plastics, one or more polymeric materials, one or more polyolefins (e.g., polyethylene, polypropylene, etc.), one or more fluoropolymers (e.g., fluorinated ethylene propylene ("FEP"), polyester, polytetrafluoroethylene, polyimide, or some other polymer, combination of polymers, aramid materials, or dielectric material(s) that does not ordinarily conduct electricity. In certain embodiments, a separate dielectric layer and shielding layer may be bonded, adhered, or otherwise joined (e.g., glued, etc.) together to form the shield 215. In other embodiments, electrically conductive material (or other shielding material) may be formed on a dielectric layer via any number of suitable techniques, such as the application of metallic ink or paint, liquid metal deposition, vapor deposition, welding, heat fusion, adherence of material to the dielectric, or etching of patches or segments from a metallic sheet. In certain embodiments, the shielding material can be over-coated with an electrically insulating film. Additionally, in certain embodiments, an shielding layer may be sandwiched between two dielectric layers. In other embodiments, at least two shielding layers may be combined with any number of suitable dielectric layers to form the shield 215. For example, a four layer construction may include respective shielding layers formed on either side of a first dielectric layer. A second dielectric layer may then be formed on one of the shielding layers to provide insulation between the shielding layer and the twisted pairs 205A-D. Indeed, any number of suitable layers of material may be utilized in a shield 215.

Additionally, in certain embodiments, one or more separator elements (not shown) may be positioned between the individual conductors of a twisted pair (generally referred to as twisted pair 105). As desired, shielding material may be optionally incorporated into one or more separator elements positioned between the conductors of respective twisted pairs 205A-D. In certain embodiments, a twisted pair separator may be woven helically with the individual conductors or conductive elements of an associated twisted pair 205. In other words, a separator element may be helically twisted with the conductors of a twisted pair 205 along a longitudinal length of the cable 200.

Each separator element may have a wide variety of suitable constructions, components, and/or cross-sectional shapes. For example, each separator may be formed as a dielectric film that is positioned between the two conductors of a twisted pair 205. In other embodiments, a separator may be formed with an H-shape, an X-shape, or any other suitable cross-sectional shape. For example, the separator may be formed to create or define one or more channels in which the twisted pair conductors may be situated. In this regard, the separator may assist in maintaining the positions of the twisted pair conductors when stresses are applied to the cable, such as pulling and bending stresses. Additionally, in certain embodiments, a separator may include a first portion positioned between the conductors of a twisted pair 205 and one or more second portions that form a shield around an outer circumference of the twisted pair. The first portion may be helically twisted between the conductors, and the second portion(s) may be helically twisted around the conductors as the separator and the pair 205 are twisted together. The first portion or dielectric portion may assist in maintaining spacing between the individual conductors of the twisted pair 205 and/or maintaining the positions of one or both of the individual conductors. The second portion(s) or shielding portions may extend from the first portion, and the second portion(s) may be individually and/or collectively wrapped around the twisted pair conductors in order to form a shield layer.

As set forth above, a wide variety of different components of a cable 200 may function as shielding elements. In certain embodiments, the electrically conductive material or other shielding material incorporated into a shield element may be relatively continuous along a longitudinal length of a cable. For example, a relatively continuous foil shield or braided shield may be utilized. In other embodiments, a shield element may be formed as a discontinuous shield element having a plurality of isolated patches of shielding material. For example, a plurality of discontinuous patches of electrically conductive material may be incorporated into the shield element (or into various components of a shield element), and gaps or spaces may be present between adjacent patches in a longitudinal direction. In yet other embodiments, a shielding element may include a plurality of patches of electrically conductive material, and adjacent patches may be connected or in electrical communication with one another via one or more fusible elements formed from electrically conductive material. Thus, a shielding element may include continuous electrically conductive material; however, when a current is applied to the shielding element, the fusible element(s) may be configured to break down or fuse such that the patches will become discontinuous. A wide variety of different patch patterns may be formed as desired in various embodiments, and a patch pattern may include a period or definite step. In other embodiments, patches may be randomly formed or situated on a base or carrier layer.

A wide variety of suitable shielding materials may be utilized as desired in a shielding element. Examples of suitable electrically conductive materials that may be utilized include, but not limited to, metallic material (e.g., silver, copper, nickel, steel, iron, annealed copper, gold, aluminum, etc.), metallic alloys, conductive composite materials, etc. Indeed, suitable electrically conductive materials may include any material having an electrical resistivity of less than approximately $1\times10^{-7}$ ohm meters at approximately 20° C. In certain embodiments, an electrically conductive material may have an electrical resistivity of less than approximately $3\times10^{-8}$ ohm meters at approximately 20° C. Electrically conductive patches may also be formed with any desired thickness, such as a thickness of about 0.5 mils (about 13 microns) or greater. For example, electrically conductive material may have a thickness between approximately 1.0 mil (25.4 microns) and approximately 3.0 mils (about 76.2 microns).

In the event that a shielding element includes patches or sections of shielding material (e.g., discontinuous patches, patches in which adjacent patches are connected by fusible elements, etc.), a wide variety of patch lengths (e.g., lengths along a longitudinal direction of a cable 200) may be utilized. As desired, the dimensions of the segments and/or patches can be selected to provide electromagnetic shielding over a specific band of electromagnetic frequencies or above or below a designated frequency threshold. In various embodiments, the segments and/or patches can have a length of about 1.64 (0.5 m), 2.46 (0.75 m), 3.28 (1.0 m), 4.92 (1.5 m), 6.56 (2.0 m), 8.20 (2.5 m), 9.84 (3.0 m), 11.48 (3.5 m), 13.12 (4.0 m), 14.76 (4.5 m), or 16.50 (5.0 m) feet or in a range between any two of these values. In other embodiments, lengths may be less than 1.64 feet (0.5 m) or greater than 16.5 feet (5.0 m). In the event that patches are electrically isolated from one another, a wide variety of suitable gaps or spaces may be utilized between adjacent patches to impede the flow of electricity. For example, isolation spaces can have a length of about 0.02 (0.5 mm), 0.04 (1.0 mm), 0.06 (1.5 mm), 0.079 (2.0 mm), 0.1 (2.5 mm), 0.12 (3.0 mm), 0.14 (3.5 mm), or 0.16 (4 mm) inches or in a range between any two of these values. In certain embodiments, patches may be formed as first patches (e.g., first patches on a first side of a dielectric material), and second patches may be formed on an opposite side of a dielectric base layer. For example, second patches may be formed to correspond with the gaps or isolation spaces between the first patches. As desired, patches may have a wide variety of different shapes and/or orientations. For example, the segments and/or patches may have a rectangular, trapezoidal, triangular, or parallelogram shape. Indeed, a wide variety of suitable configurations of shielding material may be incorporated into a shielding element.

As desired in various embodiments, a wide variety of other materials may be incorporated into the cable 200 of FIG. 2. For example, the cable 200 may include any number of conductors, twisted pairs, optical fibers, and/or other transmission media. The cable 200 may also include a wide variety of strength members, swellable materials (e.g., aramid yarns, blown swellable fibers, etc.), insulating materials, dielectric materials, flame retardants, flame suppressants or extinguishants, gels, and/or other materials. The cable 200 illustrated in FIG. 2 is provided by way of example only. Embodiments of the disclosure contemplate a wide variety of other cables and cable constructions. These other cables may include more or less components than the cable 200 illustrated in FIG. 2. Additionally, certain components may have different dimensions and/or materials than the components illustrated in FIG. 2.

Conditional language, such as, among others, "can," "could," "might," or "may," unless specifically stated otherwise, or otherwise understood within the context as used, is generally intended to convey that certain embodiments could include, while other embodiments do not include, certain features, elements, and/or operations. Thus, such conditional language is not generally intended to imply that features, elements, and/or operations are in any way required for one or more embodiments or that one or more embodiments necessarily include logic for deciding, with or without user input or prompting, whether these features, elements, and/or operations are included or are to be performed in any particular embodiment.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A communications cable, comprising:

a plurality of twisted pairs of individually insulated conductors, each conductor insulated with a material comprising fluorinated ethylene propylene; and a jacket formed around the plurality of twisted pairs, the jacket comprising foamed polyvinylidene fluoride (PVDF), wherein the cable has a maximum temperature rating of at least 125° C.

2. The communications cable of claim 1, wherein the cable satisfies electrical performance requirements of a Category 6 or Category 6A cabling standard.

3. The communications cable of claim 1, wherein each conductor has a diameter of at least 0.0240 inches.

4. The communications cable of claim 1, wherein the cable can transmit a current of at least 0.9 amps at 125° C. for at least ten years.

5. The communications cable of claim 1, wherein the PVDF is foamed at a rate between twenty percent and fifty percent.

6. The communications cable of claim 1, further comprising a separator positioned between at least two of the plurality of twisted pairs.

7. The communications cable of claim 1, further comprising a shield formed around at least one of the plurality of twisted pairs, the shield comprising electrically conductive material.

8. A communications cable, comprising:

a plurality of twisted pairs of individually insulated conductors, each conductor having a diameter of at least 0.0240 inches and insulated with a material comprising fluorinated ethylene propylene; and a jacket formed around the plurality of twisted pairs, the jacket comprising foamed polyvinylidene fluoride (PVDF), wherein the cable has a maximum temperature rating of at least 125° C.

9. The communications cable of claim 8, wherein the cable satisfies electrical performance requirements of a Category 6 or Category 6A cabling standard.

10. The communications cable of claim 8, wherein the cable can transmit a current of 0.9 amps at 125° C. for at least ten years.

11. The communications cable of claim 8, wherein the PVDF is foamed at a rate between twenty percent and fifty percent.

12. The communications cable of claim 8, further comprising a separator positioned between at least two of the plurality of twisted pairs.

13. The communications cable of claim 8, further comprising a shield formed around at least one of the plurality of twisted pairs, the shield comprising electrically conductive material.

14. A communications cable, comprising:

at least one twisted pair of individually insulated conductors, each conductor insulated with a material comprising fluorinated ethylene propylene; and a jacket formed around the at least one twisted pair, the jacket comprising foamed polyvinylidene fluoride (PVDF), wherein the cable has a maximum temperature rating of at least 125° C.

15. The communications cable of claim 14, wherein each conductor has a diameter of at least 0.0240 inches.

16. The communications cable of claim 14, wherein the cable can transmit a current of 0.9 amps at 125° C. for at least ten years.

17. The communications cable of claim 14, wherein the PVDF is foamed at a rate between twenty percent and fifty percent.

18. The communications cable of claim 1, wherein a polymeric material utilized to form the jacket consists of PVDF.

19. The communications cable of claim 8, wherein a polymeric material utilized to form the jacket consists of PVDF.

20. The communications cable of claim 14, wherein a polymeric material utilized to form the jacket consists of PVDF.

* * * * *